US006594455B2

(12) United States Patent
Lee

(10) Patent No.: US 6,594,455 B2
(45) Date of Patent: Jul. 15, 2003

(54) ELECTRICAL CONNECTION BETWEEN AN EXTERNAL POWER SUPPLY AND A HEATER FOR A FUSING ROLLER HERMETICALLY SEALED WITHIN THE FUSING ROLLER USED IN AN ELECTROPHOTOGRAPHIC IMAGE FORMATION APPARATUS

(75) Inventor: Kyung-woo Lee, Gyeonggi-do (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 0 days.

(21) Appl. No.: 10/055,938

(22) Filed: Jan. 28, 2002

(65) Prior Publication Data

US 2002/0164176 A1 Nov. 7, 2002

(30) Foreign Application Priority Data

May 4, 2001 (KR) ..... 2001-24379

(51) Int. Cl.[7] ..... G03G 15/00; G03G 15/20; H05B 3/02

(52) U.S. Cl. ..... 399/90; 219/469; 219/471; 399/330

(58) Field of Search ..... 399/90, 328, 330, 399/331; 219/216, 469, 471; 439/20, 23, 26

(56) References Cited

U.S. PATENT DOCUMENTS 3,924,943 A * 12/1975 Fletcher
4,395,109 A * 7/1983 Nakajima et al.
4,813,372 A * 3/1989 Kogure et al. ..... 219/469 X
5,722,025 A * 2/1998 Morigami et al. ..... 399/330
5,987,296 A * 11/1999 Shimada et al. ..... 399/330
6,089,875 A * 7/2000 Iwata et al. ..... 439/23 X
6,151,465 A * 11/2000 Toba et al. ..... 399/90
6,285,006 B1 * 9/2001 Hyllberg ..... 399/330 X

FOREIGN PATENT DOCUMENTS

JP 62-287277 * 12/1987
JP 63-167390 * 7/1988
JP 10-207276 * 8/1998
JP 2000-181263 * 6/2000

* cited by examiner

*Primary Examiner*—Fred L. Braun
(74) *Attorney, Agent, or Firm*—Robert E. Bushnell, Esq.

(57) ABSTRACT

A fusing roller having an electrical connection between the heater and the external power supply of an electrophotographic image formation apparatus is provided. The fusing roller having an electrical connection between the heater and the external power supply includes an electrically insulating cap and a conductive slip ring installed near the cap. The slip ring is supplied with current from an external power supply and transmits the current to a heater disposed within a hermetically sealed fusing roller by a pair of conducting caps. Due to such a structure, durability and safety can be considerably improved against many stresses such as an electrical current stress, a mechanical residual heat stress and a thermal shock according when an electrical connection between the heater and the external power supply of a fusing roller is employed.

20 Claims, 6 Drawing Sheets

ELECTRICAL CONNECTION BETWEEN AN EXTERNAL POWER SUPPLY AND A HEATER FOR A FUSING ROLLER HERMETICALLY SEALED WITHIN THE FUSING ROLLER USED IN AN ELECTROPHOTOGRAPHIC IMAGE FORMATION APPARATUS

CLAIM OF PRIORITY

This application makes reference to, incorporates the same herein, and claims all benefits accruing under 35 U.S.C. §119 from my application entitled THE FIXING ROLLER POWER-SOURCE SUPPLY APPARATUS OF ELECTROPHOTOGRAPHIC IMAGE FORMING APPARATUS filed with the Korean Industrial Property Office on May 4, 2001 and there duly assigned Serial No. 2001-24379.

BACKGROUND OF THE INVENTION

1. Field of the Invention

The present-invention-relates to a fusing roller having an electrical connection between a heater hermetically sealed within the fusing roller and an external power supply, the fusing roller being used in an electrophotographic image formation apparatus, and more particularly, to a fusing roller having an electrical connection between a heater hermetically sealed within the fusing roller and an external power supply, the electrical connection providing an improved structure for securing durability and safety in an electrophotographic image formation apparatus.

2. Description of the Related Art

Generally, electrophotographic image formation apparatuses such as copiers and laser printers using an electrophotographic development method uniformly charge a photosensitive body formed on the outer surface of a photoreceptor drum by rotating an electrostatic charging roller adjacent to the photoreceptor drum. The photosensitive body is exposed to a laser beam emitted from a laser scanning unit (LSU) in a predetermined pattern so that a desired electrostatic latent image is formed on the surface of the photosensitive body. A developer supplies a toner to the photosensitive body, thereby developing the electrostatic latent image formed on the photosensitive body into a visible image, i.e., a toner image in powder. Thereafter, a predetermined transferring voltage is applied to a transferring roller contacting the photoreceptor drum at a predetermined pressure and to the photoreceptor drum on which the toner image is formed. In this state, when a sheet, i.e., a recording medium, passes through the gap between the photoreceptor drum and the transferring roller, the toner image is transferred to the sheet. A fixing unit including a fusing roller heats the sheet to which the toner image is transferred in order to temporarily fuse the toner image in power state to be stuck to the sheet. Radiant heat generated from a heating source of the fixing unit heats the surface of the fusing roller to a predetermined temperature. The heating source is supplied with power from an external power supply and generates radiant heat. The heating source is connected to the external power supply through an electrical connection between the heater and the external power supply, thereby being supplied with current.

It is generally desirable to have the heating unit located on an inside of a cylindrical fusing roller and have the heating unit hermetically sealed from exterior elements because the heating unit and the fusing roller undergo sudden electrical and thermal changes versus time. If the heating unit were exterior to the fusing roller, a safety hazard would be present as a result of the power surges, and the mechanical durability of the device would be sacrificed. What is needed is a design for delivering power to the hermetically sealed heater inside the fusing roller without compromising the hermetic seal, the safety of the device, and without compromising the mechanical durability of the fusing roller unit.

SUMMARY OF THE INVENTION

It is therefore an object to provide an improved fusing roller used in an electrophotographic apparatus.

It is also an object to provide a fusing roller where the heating unit is located inside the fusing roller and the heating unit extends the entire length of the fusing roller.

It is further an object to hermetically seal the interior of the fusing roller having the heating element to prevent exposure of the heating element from the atmosphere and to prevent any working fluid or substance initially introduced to the interior of the fusing roller not to leak out or degrade.

It is further an object to provide an electrical connection between the heating element hermetically located within the fusing roller to a power supply located exterior to the fusing roller without compromising on the quality of the hermetic seal, on the safety of the device and on the mechanical durability of the fusing roller unit even when the external power supply applies large power surges to the heater stored within the fusing roller used in an electrophotographic image formation apparatus.

Accordingly, to achieve the above objects of the invention, in one embodiment, there is provided a fusing roller with an electrical connection between the heater and the external power supply for electrically connecting an external power supply to a heater in an electrophotographic image formation apparatus. The fusing roller having the electrical connection between the heater and the external power supply is installed at both ends of a fusing roller and includes a pipe-shaped cap and a slip ring. The cap is formed of a nonconductive material and provided with a hole through which a lead of the heater can pass at one side. The slip ring is installed about the cap and a coupler electrically contacting the lead (or end) of the heater.

In other embodiments, there is provided a fusing roller with an electrical connection between the heater and an external power supply of an electrophotographic image formation apparatus. The electrical connection between the heater and the external power supply includes a pipe-shaped coupling cap and a slip ring. The coupling cap is nonconductive and is connected to a conductive cap of a heater at one end and to a conductive slip ring at the other end. The coupling cap is provided with a via-hole through which a lead of the heater passes through. The slip ring is installed at one end of the coupling cap and transmits current supplied from an external power supply to the heater.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PRESENT INVENTION

Figure 1:
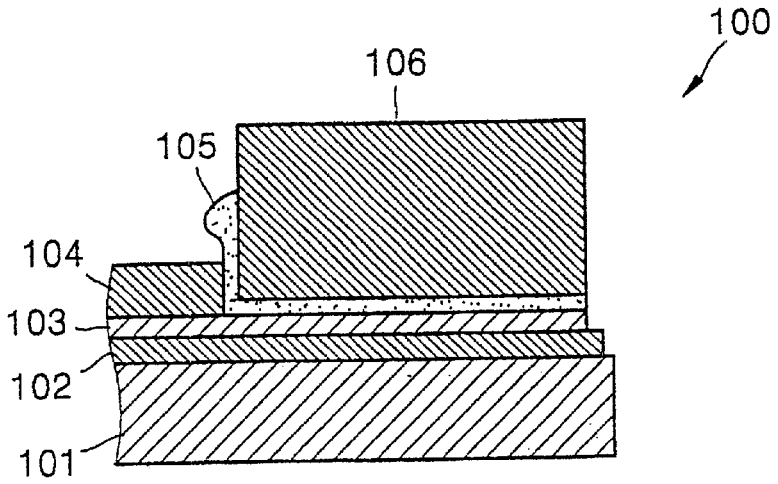
FIG. 1 is a sectional view of one end of a fusing roller used in an electrophotographic image forming apparatus illustrating the electrical connection between the heater and an external power supply for the fusing roller.
Figure 2:
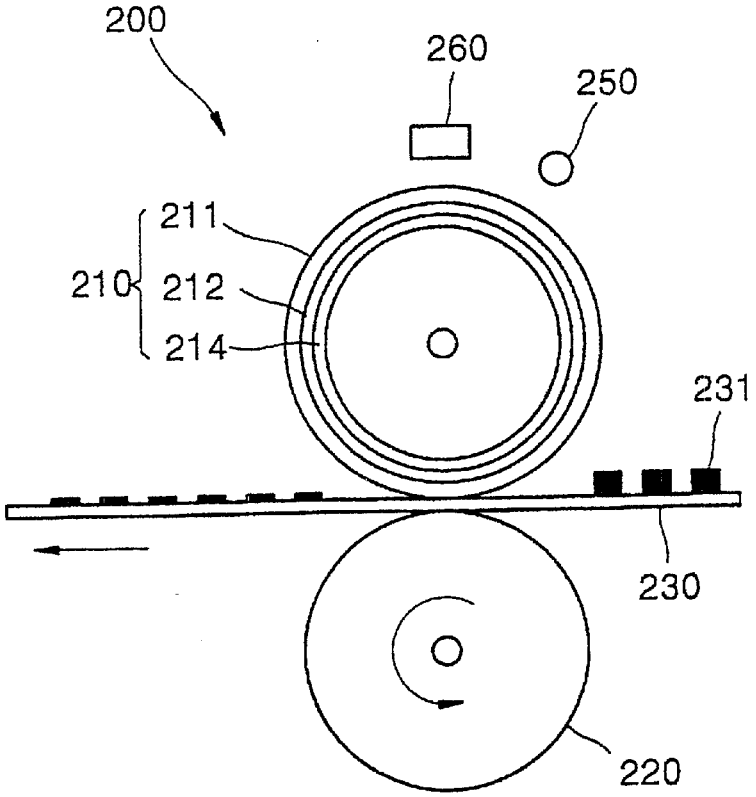
FIG. 2 is a sectional view of the electrical connection between the heater hermetically inserted inside a fusing roller and an external power supply, the electrical connection being at one end of the cylindrical surface of the fusing roller according to the present invention.
Figure 3:
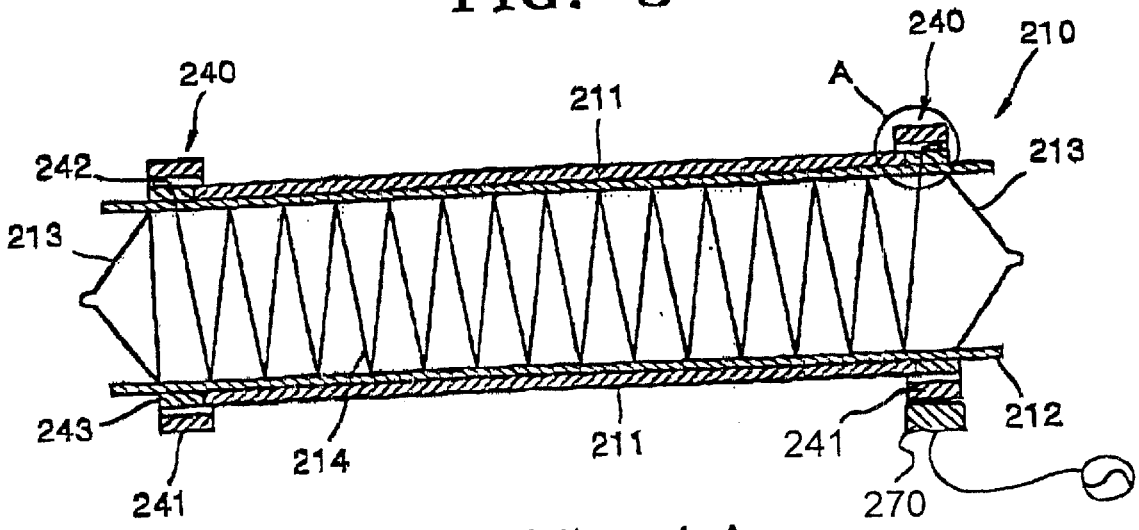
FIG. 3 is a sectional view of a fusing roller unit illustrating electrical connections between the heater hermetically sealed within the fusing roller and an external power supply according to the first embodiment of the present invention.
Figure 5:
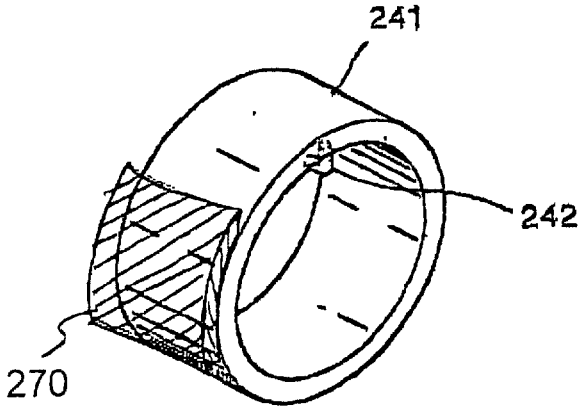
FIG. 5 is a perspective view of the slip ring of a fusing roller used as part of the electrical connection between the heater and an external power supply according to the first embodiment of the present invention.

FIG. 1 is a vertical sectional view of an rapid heating/cooling surface apparatus forming an electrical connection between a power supply (not shown) and a heater 103 of a heating roller unit 100. Referring to FIG. 1, the heating roller unit 100 includes a roller 101, a dielectric layer 102 formed on the roller 101, a heating layer 103 which is provided on the dielectric layer 102 and generates heat, a protective layer 104 provided on the heating layer 103, and an electrical connection between the heating layer 103 and an external power supply.

The electrical connection apparatus between the heating layer 103 and an external power supply is formed by depositing a conductive adhesive 105 on the heating layer 103 and mounting a slip ring 106 thereon. The slip ring 106 is supplied with power from an external power supply and transmits the power to the heating layer 103. The slip ring 106 rotates when the roller 101 rotates.

The electrical connection apparatus between the heater and an external power supply used in such a rapid heating/cooling surface of a fusing roller by directly installing the resistive heating layer 103 on the surface of the roller 101 and fixing the slip ring 106 to the heating layer 103 with the conductive adhesive 105. This electrical connection between the heating layer 103 and an external power supply is repeatedly and continuously exposed to many stresses such as an electrical current stress, a mechanical residual heat stress and a thermal shock during use in an electrophographic image forming apparatus.

Since temperature should be increased from room temperature to fusing temperature within a short time, the an electrical connection between the heating layer 103 and an external power supply is repeatedly exposed to many shocks at an initial stage and during operation. Accordingly, the electrical connection between the heating layer 103 and an external power supply illustrated in FIG. 1 lacks durability and safety. In addition, since a conductive adhesive 105 is used, current can flow across parts other than heating layer 103. Accordingly, a user can be exposed to the danger of an electric shock.

Particularly, an electrical connection between the heating layer 103 and an external power supply is essential to a fusing roller unit using a heat pipe. Therefore, it is necessary that the electrical connection between the heating layer 103 and an external power supply is designed for safety and durability unlike the electrical connection between the heating layer 103 and an external power supply used in FIG. 1.

Referring to FIGS. 2 through 5, a fixing unit 200 of an electrophotographic image formation apparatus according to the present invention includes a fusing roller unit 210 rotating in a direction in which a sheet 230 with a toner image 231 is discharged, that is, clockwise, and a pressure roller 220 which rotates counterclockwise in contact with the fusing roller unit 210 such that the sheet 230 passes therebetween.

The fusing roller unit 210 includes a fusing roller 212 which has a protective layer 211 such as a Teflon coating on its surface and has a pipe shape, and of which both ends are sealed hermetically with conductive caps 213, a resistive heater 214 which is installed within the fusing roller 212 and supplied with current to generate heat, electrical connection apparatus 240 between the heater 214 and an external power supply (not shown) for electrically connecting the resistive heater 214 to an external power supply (not shown) for the supply of current while maintaining the integrety of the hermetic seal, and power transmission caps (not shown) which are installed at both ends of the fusing roller 212, connected to a gear installed at a frame (not shown), and rotate the fusing roller unit 210.

The fusing roller has electrical connection apparatus 240 installed between the heater 214 and an external power supply at both ends of the fusing roller 212. Each set of electrical connection apparatus between heater 214 and an external power supply includes a non-conductive cap 243 and a slip ring 241 installed to wrap around cap 243. The slip ring 241 is connected to the external power supply, thereby transmitting current to the resistive heater 214.

Non-conductive cap 243 has a pipe shape and is inserted onto the fusing roller 212. An adhesive 245 is interposed between the fusing roller 212 and the non-conductive cap 243 so that the non-conductive cap 243 is physically fixed to the fusing roller 212. A through hole 244 is formed in a part of the non-conductive cap 243 so that lead 214*a* of resistive heater 214 can pass through the non-conductive cap 243. In an alternative embodiment, a slit, rather than a through hole 244 can be used to allow resistive lead 214*a* to pass therethrough. If cap 243 were conductive, current may flow across other parts creating a safety hazard. Accordingly, it is preferable to form the cap 243 be made of a nonconductive material.

Conductive slip ring 241 is electrically connected to an external power supply 270, thereby supplying current to the resistive heater 214. The slip ring 241 has a pipe shape and wraps around non-conductive cap 243. It is preferable to physically attach slip ring 241 to non-conductive cap 243 with a non-conductive adhesive 245.

Figure 4A:
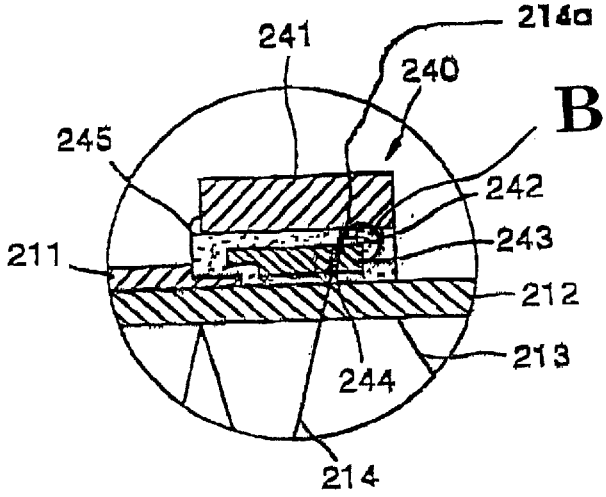
FIG. 4A is an enlarged sectional view of the part A of FIG. 3.
Figure 4B:
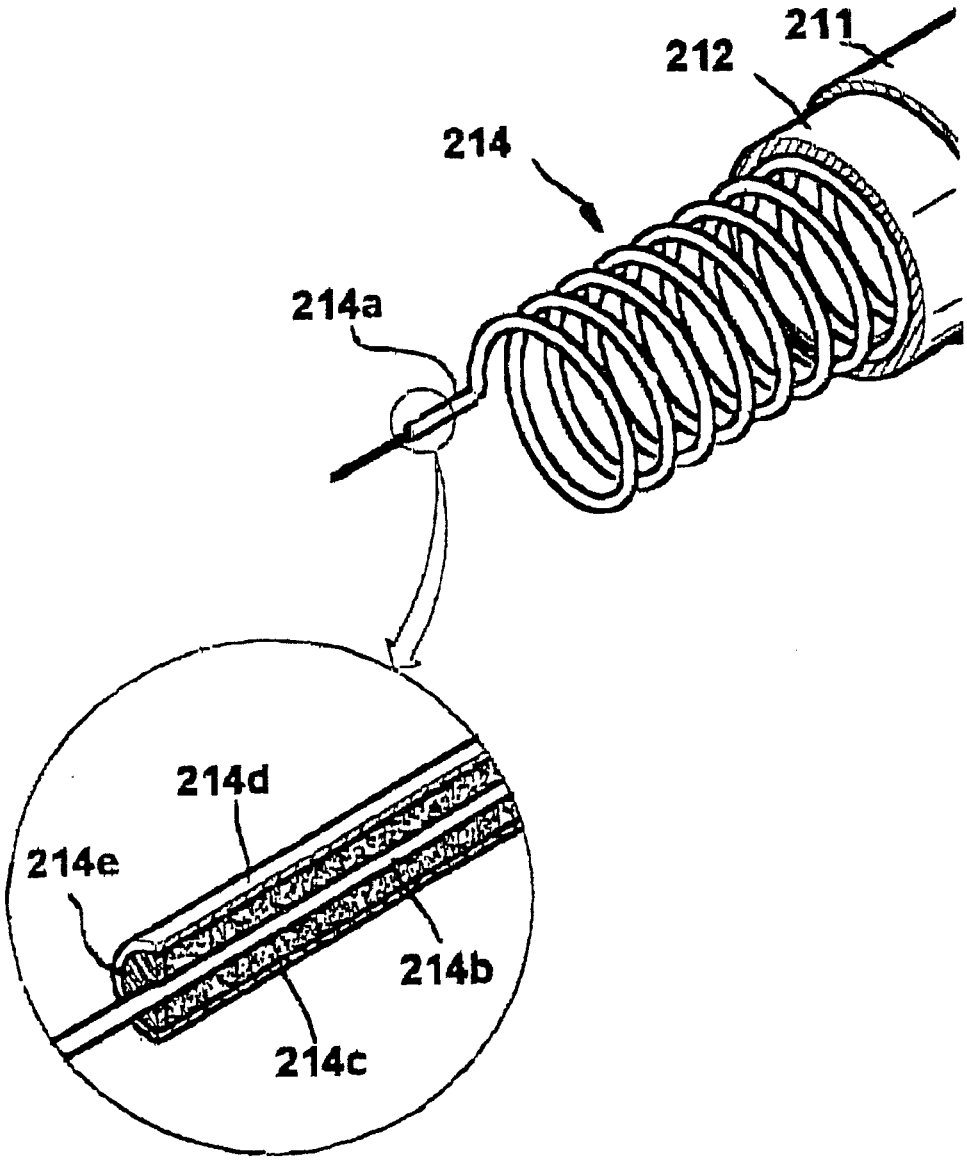
FIG. 4B is an enlarged sectional view of part B of FIG. 4A.

The slip ring 241 includes a conductive coupler 242 on an internal surface thereof. The slip ring 241 is directly attached to lead 214*a* of heater 214 by way of coupler 242. It is preferable to form the coupler 242 to have a larger diameter than that of lead 214*a* so that the lead 214*a* can be inserted into the coupler 242. FIG. 4B illustrates how lead 214*a* forms an electrical connection with coupler 242 of slip ring 241 without electrically charging fusing roller 212. The center of resistive heater 214 is heat generating wire 214*b* which is made of an electrically resistive material such as FeCr or NiCr. Heat generating wire 214*b* is surrounded by a layer of electrically insulating covering layer 214*c* made out of a dielectric material such as MgO. Surrounding the electrically insulating covering layer 214*c* is a protective outer layer 214*d* preventing electrically insulating layer 214*c* from being exposed to the atmosphere. Since the covering layer 214*c* is an electrically insulating layer, an electric current does not flow through the covering layer 214*c* but heat generated by the heat generating wire 214*b* is transferred through the covering layer 214*c* to the outer layer 214*d*. At lead 214*a*, only heat generating wire 214*b* remains, as seal 214*e* prevents electrically insulating covering layer 214*c* from being exposed to the atmosphere. With this arrangement, power can pass from power supply unit 270 to slip ring 241 to resistive heater 214 inside fusing roller unit 210 while not energizing fusing roller 212 or conductive cap 213 and while maintaining a hermetic seal within fusing roller unit 210. It is apparent that various modifications can be made in order to connect the slip ring 241 to the resistive heater 214.

A thermistor 250 for sensing the surface temperature of the fusing roller 212 and protective layer 211 is installed above the combination of fusing roller 212 and protective layer 211. A thermostat 260, for cutting off the power when the surface temperature of the fusing roller 212 and protective layer 211 rapidly increases, is also installed above the fusing roller 212.

The following description concerns the operations of a fusing roller unit having the novel electrical connection between the heater 214 and an external power supply will be described. The fusing roller unit 210 rotates in connection with the separately installed power transmission cap and the gear installed at the frame. In order to fuse a powder-state toner to a sheet, current should be supplied to the resistive heater 214 such that the temperature of the fusing roller 212 is increased to a target temperature. The fusing roller 212 having the novel electrical connection between the heater 214 and an external power supply 270 is always in contact with an electrode separately installed at the frame and supplied with current from the electrode while rotating together with the fusing roller unit 210. The current supplied from the electrode is transmitted to the slip ring 241 and then to the resistive heater 214 through the coupler 242. Accordingly, the resistive heater 214 generates heat, and the heat is transmitted to the fusing roller 212. Consequently, the surface temperature of the fusing roller 212 increases to the target temperature necessary for fusing the toner.

When a fusing temperature for a normal toner image is 160–190° C., the fusing roller unit 210 of the present invention reaches the target temperature within seconds. Thereafter, the thermistor 250 senses the surface temperature of the fusing roller 212 and maintains the surface temperature within a predetermined range to properly fuse toner. When the surface temperature rapidly increases because the thermistor 250 fails in controlling the surface temperature, the thermostat 260 sensing the surface temperature cuts off power to prevent a rapid increase in the surface temperature. Such a power supply operation can vary with the target temperature. For a given power supply, a periodical ON/OFF time, a duty ratio, or PI action can be controlled.

Figure 6:
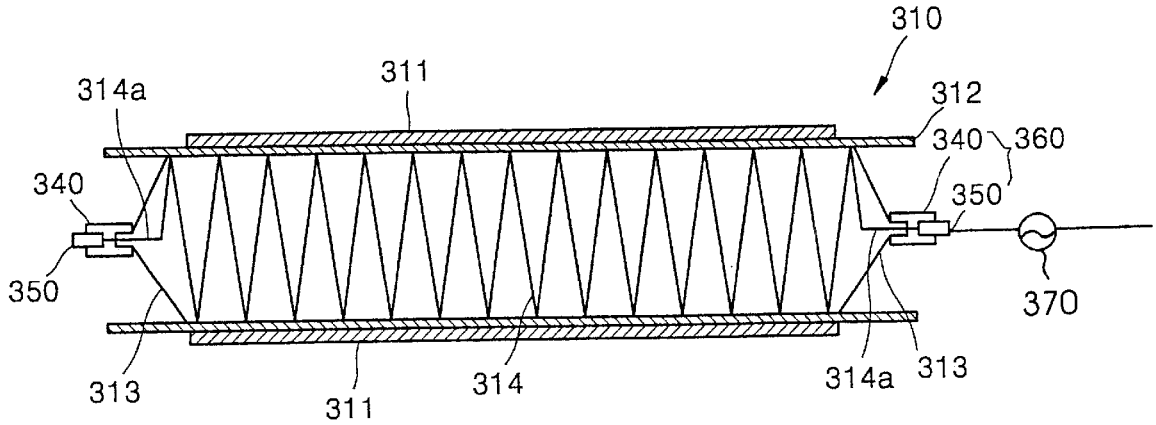
FIG. 6 is a sectional view of a fusing roller unit having electrical connections between the heater hermetically sealed within the fusing roller and an external power supply, the electrical connection being located on an axis through the fusing roller and being installed at the center of a conductive coupling cap according to a second embodiment of the present invention.
Figure 7:
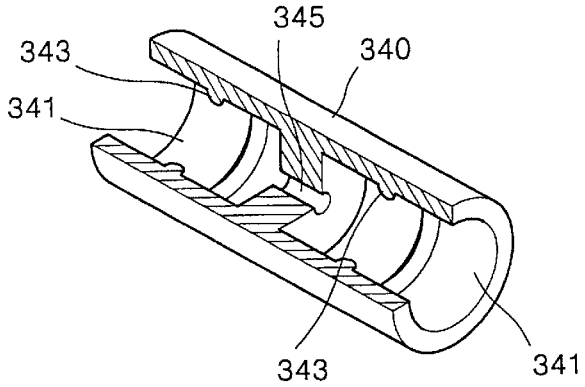
FIG. 7 is an exploded perspective view of the coupling cap of FIG. 6.
Figure 8:
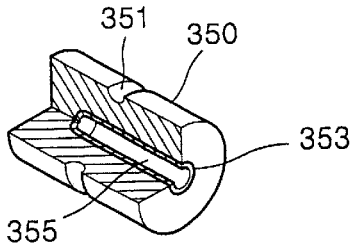
FIG. 8 is an exploded perspective view of the slip ring of FIG. 6.

FIG. 6 is a sectional view of a fusing roller unit having a novel electrical connection apparatus 360 between the heater 314 and an external power supply (not shown) according to a second embodiment of the present invention. FIG. 7 is an exploded perspective view of coupling cap 340 of FIG. 6. FIG. 8 is an exploded perspective view slip ring 350 of FIG. 6.

Referring to FIGS. 6 through 8, a fusing roller unit 310 includes a fusing roller 312, a resistive heater 314, an-electrical connection between the heater 314 and an external power supply, and a power transmission cap (not shown). The fusing roller 312 has a protective layer 311 on its surface and has a pipe shape. Both ends of the fusing roller 312 are hermetically sealed with conductive caps 313. The resistive heater 314 is installed within the fusing roller 312. Both leads 314*a* of the resistive heater 314 are led out through the conductive caps 313. The resistive heater 314 is supplied with current from an external power supply, thereby generating heat. The novel electrical connection apparatus between the heater 314 and an external power supply supplies the current from an external power supply to the resistive heater 314. The power transmission cap is installed at each of both ends of the fusing roller 312 to be connected to a gear installed at a frame, thereby rotating the fusing roller unit 310.

The process for forming the hermetically sealed fusing roller illustrated in FIG. 6 is as follows. As illustrated in FIG. 6, the resistive heater 314 is inserted into the interior of the fusing roller 312. Next, the conductive cap 313 is welded at every end of the fusing roller 312 and lead 314*a* of resistive heater 314 is extracted through the end hole (not shown in FIG. 6) of the conductive cap. Next, the gap between the end hole of the conductive cap 313 and the lead 314*a* is welded shut forming a seal. Then, air is extracted from the interior of the fusing roller 312 through another hole (not shown in FIG. 6) formed on the conductive cap 313 and then this second hole is sealed. Consequently, the interior of the fusing roller 312 is evacuated.

The novel electrical connection apparatus 360 between the heater 314 and an external power supply includes a coupling cap 340 and a slip ring 350. The coupling cap 340 is formed of a nonconductive material and provided with sockets 341, into which the conductive caps 313 and slip rings 350 are inserted, at its both sides. A through hole 345 is formed between the sockets 341 so that each lead 314*a* of the resistive heater 314 can pass through the coupling cap 340. A fastener is formed on the inner side of each socket 341 so that the slip ring 350 and conductive cap 313 can be physically secured into the socket 341.

The fastener includes a projection 343 formed around the inside of the socket 341 and a recess 351 formed, corresponding to the projection 343, around the outside of each of the slip ring 350 and the conductive cap 313. Accordingly, when each of the slip ring 350 and the conductive cap 313 is inserted into the socket 341, the projection 343 is inserted into the recess 351 so that the slip ring 351 and the conductive cap 313 are physically secured in the sockets 341. In other embodiments, projections 343 can be formed on the slip ring 350 and the conductive cap 313, and recesses 351 can be formed on the sockets 341.

The slip ring 350 has a pipe shape and is formed of a conductive material. Inside the slip ring 350 is formed a hole 353 into which the lead 314*a* of the resistive heater 314 can be inserted. A conductive protective layer 355 for protecting the lead 314*a* is formed on the inside of the hole 353. The conductive protective layer 355 is provided for protecting the resistive heater having a small diameter from damage caused by a shock during rotation or damage caused by an external stress. Various methods can be used for connecting the lead 314*a* of the resistive heater 314 to the slip ring 350. Usually, it is preferable to insert the lead 314*a* into the hole 353 of the slip ring 350 and externally apply pressure to them so that the hole 353 can contact the lead 314*a*. The structure of lead 314*a* and resistive heater 314 is similar to the structure illustrated in FIGS. 3 and 4B, allowing electrical power to transmit from a power supply electrically connected to slip ring 350 to the interior of fusing roller unit 310 while not energizing conductive caps 313 and while maintaining the integrity of the hermetic seal found inside fusing roller unit 310.

Figure 9:
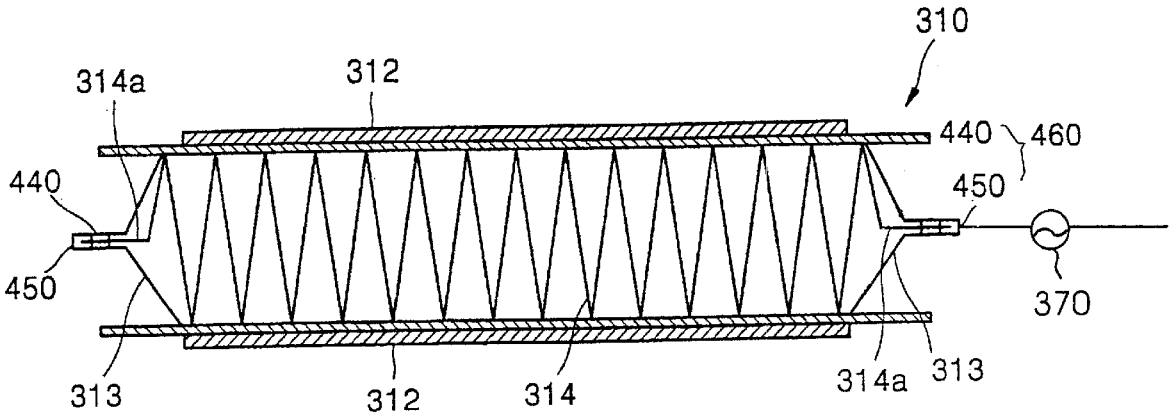
FIG. 9 is a sectional view of a fusing roller unit having electrical connections between the heater hermetically stored within the fusing roller and an external power supply according to a third embodiment of the present invention.
Figure 10:
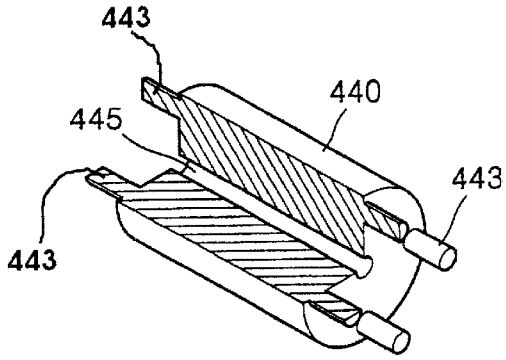
FIG. 10 is an exploded perspective view of the coupling cap used to form one of the two electrical connections between the heater and an external power supply illustrated in FIG. 9.
Figure 11:
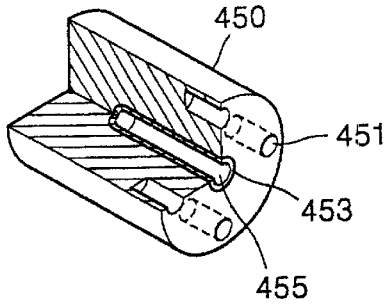
FIG. 11 is an exploded perspective view of the slip ring used to form one of the two electrical connections between the heater and an external power supply illustrated in FIG. 9.

FIG. 9 is a sectional view of a fusing roller unit having a novel electrical connection apparatus between the heater 314 and an external power supply (not shown) according to a third embodiment of the present invention. FIG. 10 is an exploded perspective view of coupling cap 440 illustrated in FIG. 9. FIG. 11 is an exploded perspective view of slip ring 450 illustrated in FIG. 9. In the second and third embodiments, the same reference numerals denote the same members having the same functions.

Referring to FIGS. 9 through 11, the electrical connection apparatus 460 between the heater 314 and an external power supply includes a coupling cap 440 and a slip ring 450. The coupling cap 440 is formed of a nonconductive material and provided with a plurality of projections 443 functioning as a fastener connecting the conductive cap 313 with the slip ring 450 so that the coupling cap 440 can be physically secured to the conductive cap 313 and to the slip ring 450. In addition, the coupling cap 440 is provided with a through hole 445 so that the lead 314*a* of the resistive heater 314 can pass through the coupling cap 440.

Corresponding to the projections 443, recesses 451 are formed in the slip ring 450 and in the conductive cap 313. Accordingly, when the slip ring 450 and the conductive cap 313 are connected to the coupling cap 440, the projections 443 are inserted to the corresponding recesses 451, respectively, thereby fixing the slip ring 450 and the conductive cap 313 to the coupling cap 440. The slip ring 450 is provided with a hole 453, into which the lead 314*a* of the resistive heater 314 is inserted, and a conductive protective layer 455 for protecting the lead 314*a*. Lead 314*a* of resistive heater 314 has a structure similar to that of FIGS. 3 and 4B to allow power from a power supply connected to slip ring 450 to transmit inside the hermetically sealed interior portion of fusing roller unit 310 without energizing conductive cap 313. The process for forming the hermetic seal is similar to the process described in the description of FIG. 6.

In other embodiments, recesses 451 can be formed in the coupling cap 440, and the projections 443 can be formed on both the slip ring 450 and the conductive cap 313. Further embodiments include having the recesses 451 and the projection 443 formed at the opposite sides, respectively, of the coupling cap 440, and corresponding to them, the projection 443 or the recesses 451 formed at each of the slip ring 450 and the conductive cap 313.

Figure 12:
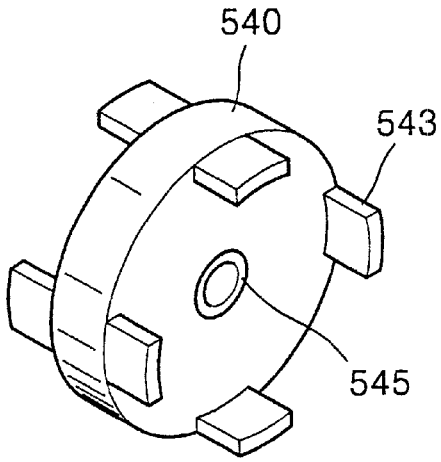
FIG. 12 is a perspective view of a coupling cap used to form one of the two electrical connections between the heater and an external power supply according to a fourth embodiment of the present invention.
Figure 13:
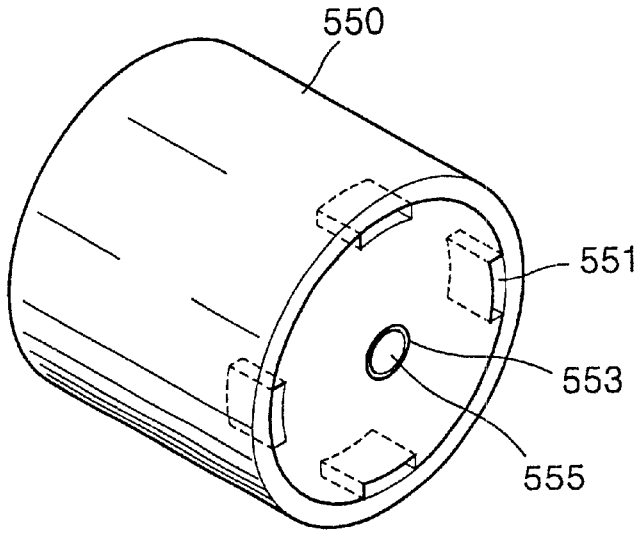
FIG. 13 is a perspective view of a slip ring used to form one of the two electrical connections between the heater and an external power supply according to the fourth embodiment of the present invention.

FIG. 12 is a perspective view of a coupling cap 540 for a fusing roller as part of electrical connection apparatus between a heater and an external power supply according to a fourth embodiment of the present invention. FIG. 13 is a perspective view of a slip ring 550 as part of electrical connection apparatus between a heater and an external power supply according to the fourth embodiment of the present invention. In describing FIGS. 12 and 13, the same reference numerals as those in FIG. 9 illustrating the third embodiment denote the same members having the same functions as those in FIG. 9.

Referring to FIGS. 12 and 13, a coupling cap 540 has a pipe shape and is provided with a through hole 545, through which the lead 314*a* of the resistive heater 314 passes, at its center. Unlike the first 3 embodiments, the fastener between the coupling cap 540 and the slip ring 550 as well as the fastener between the coupling cap 540 and the conductive cap 313 are distinct. At both sides of the coupling cap 540 are formed a plurality of quadrilateral projections 543 toward the slip ring 550 and the conductive cap 313 in parallel with a direction in which the slip ring 550 and the conductive cap 313 are connected to the coupling cap 540. Corresponding to the projections 543, a plurality of recesses 551 are formed in the slip ring 550 and the conductive cap 313. Accordingly, when the slip ring 550 and the conductive cap 313 are connected to the coupling cap 540, the projections 543 are inserted into the recesses 551 so that the slip ring 550 and the conductive cap 313 are fixed to the coupling cap 540. The slip ring 550 is provided with a hole 553, into which the lead 314*a* of the resistive heater 314 is inserted, and a protective layer 555 for protecting the lead 314*a*.

Other embodiments contemplated include having the recesses 551 formed in the coupling cap 540, and the projections 543 formed at the slip ring 550 and the conductive cap 313. Still other embodiments include projections 543 and the recesses 551 may be formed at the opposite sides of the coupling cap 540, and corresponding to them, the recesses 551 or the projections 543 may be formed at each of the slip ring 550 and the conductive cap 313.

As described above, apparatus for an electrical connection between a hermetically sealed heater inside the fusing roller and a power supply external to the fusing roller of an electrophotographic image formation apparatus according to the present invention can considerably improve durability and safety against many stresses such as an electrical current stress, a mechanical residual heat stress and a thermal shock according to a use environment to which an electrical connection between the heater and the external power supply is repeatedly and continuously exposed.

What is claimed is:

1. A fusing roller unit for use in an electrophotographic image forming apparatus, comprising:

a cylindrical-shaped fusing roller, said roller having an outer surface and an interior, said roller having two ends;

a pair of conductive caps, each one of said pair located at respective ones of said two ends of said fusing roller, each cap forming a hermetic seal with said fusing roller;

a resistive heater disposed along an entire length of said fusing roller and being disposed inside said fusing roller between said pair of conductive caps, each end of said resistive heater forming a pair of leads;

an power supply located external to said fusing roller supplying power to said resistive heater enabling said fusing roller to rapidly ramp up to a fusing temperature to bind toner to a sheet of recording medium; and an electrical connection apparatus positioned at each of said two ends of said fusing roller, designed to deliver power from said power supply to said resistive heater while maintaining an integrity of said hermetic seal and allowing said fusing roller to rotate, said connection apparatus comprising:

a ring-shaped, non-conductive cap perforated by a through hole through which one of said pair of leads passes therethrough, said non-conductive cap formed around one of said two ends of said fusing roller;

a conductive slip ring formed around said ring-shaped non-conductive cap at one of said two ends of said fusing roller, said slip ring having an inner surface and an outer surface, said inner surface having a conductive coupler protruding from the inner surface of said slip ring, said conductive slip ring being electrically connected to said power supply; and non-conductive adhesive attaching said non-conductive, ring-shaped cap to said fusing roller and attaching said slip ring around said non-conductive cap while keeping said non-conductive cap spacially separated from said fusing roller and keeping said slip ring spacially separated from said non-conductive cap, wherein one of said two leads of said resistive heater extends through said fusing roller, said non-conductive adhesive, said through hole and electrically attaches to said coupler.

2. The fusing roller of claim 1, wherein a portion of said outer surface between both electrical connection apparatuses being covered with a protective surface.

3. The fusing roller of claim 2, wherein said protective surface being Teflon.

4. A fusing roller unit for use in an electrophotographic image forming apparatus, comprising:

a cylindrical-shaped fusing roller, said roller having an outer surface and an interior, said roller having two ends, said fusing roller having a central axis;

a pair of conductive caps, each one of said pair located at respective ones of said two ends of said fusing roller, each cap forming a hermetic seal with said fusing roller;

a resistive heater disposed along an entire length of said fusing roller and being disposed inside said fusing roller between said pair of conductive caps, each end of said resistive heater forming a pair of leads;

an power supply located external to said fusing roller supplying power to said resistive heater enabling said fusing roller to rapidly ramp up to a fusing temperature to bind toner to a sheet of recording medium; and an electrical connection apparatus disposed on each end of said fusing roller at about said central axis of said fusing roller, said electrical connection apparatus comprising:

a conductive slip ring electrically connected to said power supply;

a coupling cap made of nonconductive material designed to electrically connect one of said two leads of said resistive heater to said slip ring; and a pair of fasteners, a first designed to physically attach one of said two conductive caps to said coupling cap and a second designed to physically attach said slip ring to said coupling cap.

5. The fusing roller of claim 4, wherein said coupling cap being attached to one of said pair of conductive caps having a lead protruding therefrom.

6. The fusing roller of claim 4, wherein said coupling cap having a through hole designed to have said lead protruding from said central axis of said coupling cap pass through said through hole and electrically connect to said slip ring.

7. The fusing roller of claim 4, wherein said coupling cap having one socket at both ends to accommodate said conductive cap at one end and to accommodate said slip ring at the other end, both sockets being connected by a through hole through which said lead passes.

8. The fusing roller of claim 7, wherein said slip ring being perforated by a hole that aligns with said through hole of said coupling cap allowing said lead to pass into said hole in said slip ring to make electrical contact with said power supply.

9. The fusing roller of claim 8, wherein said hole in said slip ring being coated with a protective coating to protect said lead from mechanical damage.

10. The fusing roller of claim 6, wherein said first and second fasteners comprise annular projections disposed within sockets disposed on each side of said coupling cap that mate with annular grooves on an outer surface of said slip ring and on said conductive cap.

11. The fusing roller of claim 6, wherein said first and second fasteners comprise annular grooves disposed within sockets disposed on each side of said coupling cap that mate with annular projections formed on an outer surface of said slip ring and on said conductive cap.

12. The fusing roller of claim 6, wherein said first and second fasteners comprise a plurality of projections at each end of said coupling cap that mates with a plurality of recesses in both said slip ring and said conductive cap.

13. The fusing roller of claim 6, wherein said first and second fasteners comprise a plurality of recesses at each end of said coupling cap that mates with a plurality of projections extending from both said slip ring and said conductive cap.

14. The fusing roller of claim 12, wherein said projections and recesses are cylindrical in shape.

15. The fusing roller of claim 13, wherein said projections and recesses are cylindrical in shape.

16. The fusing roller of claim 12, wherein said projections and recesses are thin and flat in shape.

17. The fusing roller of claim 13, wherein said projections and recesses are thin and flat in shape.

18. An electrical connection apparatus disposed on each end of a hermetically sealed fusing roller for an electrophotographic imaging apparatus at about said central axis of said fusing roller to electrically connect a resistive heating element disposed within said fusing roller to a power supply outside said fusing roller, said electrical connection apparatus comprising:

a coupling cap made of nonconductive material and having two ends opposite each other, each of said two ends having fasteners, said two ends being connected by a narrow through hole; and a conductive slip ring electrically connected to said power supply and being fastened by said fastener to one of said two ends of said coupling cap, wherein the other end of said coupling cap being fastened to a conductive cap at a central axis of said fusing roller where a lead for said resistive heating element protrudes therefrom, said lead extends through said through hole of said coupling cap and electrically connects to said slip ring.

19. The electrical connection apparatus of claim 18, wherein said coupling cap is cylindrical in shape and has a cylindrical socket at each of said two ends to accommodate cylindrical portions of said slip ring and said conductive cap.

20. The electrical connection apparatus of claim 18, wherein said fastening means are protrusions that extend into recesses causing said slip ring to be physically secured to said coupling cap and said coupling cap to be physically secured to said conductive cap.

* * * * *